US005876262A

United States Patent [19]

Kelly et al.

[11] Patent Number: 5,876,262

[45] Date of Patent: Mar. 2, 1999

[54] LIGHT TABLE

[75] Inventors: Ray G. Kelly; Sharon Turnbough, both of St. Louis, Mo.; Klaus Moser, Sullivan, N.H.

[73] Assignee: Angeles Group, Inc., Pacific, Mo.

[21] Appl. No.: 613,908

[22] Filed: Mar. 11, 1996

[51] Int. Cl.[6] ..... A63H 33/22; A63H 33/06

[52] U.S. Cl. ..... 446/118; 446/219; 362/97; 108/23

[58] Field of Search ..... 446/118, 91, 219; 434/407; 273/309; 362/97; 40/547, 575, 579; 108/6, 23, 25

[56] References Cited

U.S. PATENT DOCUMENTS

| | | | |
|---|---|---|---|
| 1,392,726 | 10/1921 | Watkins | 434/407 |
| 1,549,146 | 8/1925 | Miner . | |
| 3,274,727 | 9/1966 | Zander . | |
| 3,589,056 | 6/1971 | Glass et al. | 446/118 X |
| 3,634,678 | 1/1972 | Glass et al. | 446/91 X |
| 3,805,710 | 4/1974 | Leshem | 108/6 |
| 3,838,535 | 10/1974 | Larws . | |
| 3,849,912 | 11/1974 | Kemnitzer | 446/118 X |
| 4,582,496 | 4/1986 | Larws | 446/104 |
| 4,813,904 | 3/1989 | Larws | 446/118 |
| 4,891,030 | 1/1990 | Gertzfeld | 446/118 |
| 4,972,781 | 11/1990 | Montgomery et al. | 108/25 |
| 5,055,081 | 10/1991 | Nayak | 446/118 X |
| 5,344,033 | 9/1994 | Herman | 108/6 X |
| 5,421,270 | 6/1995 | Kelly | 108/25 |
| 5,605,393 | 2/1997 | Cucchi et al. | 108/23 X |

*Primary Examiner*—Kien T. Nguyen
*Assistant Examiner*—Jeffrey D. Carlson
*Attorney, Agent, or Firm*—Woodard, Emhardt, Naughton Moriarty & McNett

[57] ABSTRACT

A light table having a table top surface fabricated of translucent or transparent polymer material, one surface being of a smooth and planar configuration, while the alternative surface may include a series of integral sockets, and into which various light blocks or game pieces may insert, and be built up into structured configurations. The smooth table top surface may be used with planar light transmitting pieces, tinted to various colors, be either translucent or transparent in configuration, and through their combination can provide both pleasure through their usage, and a source of education to the child regarding light and its transmission and color mixing to attain various coloration. The light blocks may be fabricated as fiber optics, and scintillating fiber optics, or of translucent material, to enhance the transmission of light emanating from the illuminating lamps provided within the interchangeable table top surfaces of this invention. The light table may incline.

15 Claims, 6 Drawing Sheets

LIGHT TABLE

BACKGROUND OF THE INVENTION

This invention relates generally to a light table, and more specifically to a table that incorporates illumination means within its table top surface, projects that transmitted light through the table top and in cooperation with a series of light block pieces, can project colored images to the table user, which normally comprises children at play within a nursery or day care setting, or in a school, and the invention may also be used, in smaller forms, within the home.

Various types of tables, for use at play, even within a nursery, have been developed in the prior art. For example, as can be seen from the disclosure within U.S. Pat. No. 5,421,270, invented by the same applicant herein, a base panel is disclosed, in the form of a table, and which panel includes a series of bores therein, which are arranged at precise locations, and into which various building blocks may be inserted, and built upon, to the pleasure and education of the children, particularly within a nursery. This concept of utilizing a table, for application of building blocks thereto, is known in the art, and has normally been a means for attaining and maintaining the interest of children, particularly within an activity center, such as at the day care, school and nursery locations.

Other examples of activity type tables, in the prior art, are also shown in the U.S. Pat. No. 5,055,081, to Nayak, which discloses a play table and activity center, comprising a table top, containing a plurality of recesses, and to which individual game segments may be plied. Another example of a game type table, in this particular instance apparently for use as a light weight foldable tray, is disclosed in the patent to Montgomery, et al, U.S. Pat. No. 4,972,781.

Various types of game pieces, for use for application as a plurality of connecting blocks, is shown in the United States patent to Larws, U.S. Pat. No. 3,838,535, identified as toy blocks dimensioned and configured for plural connections. A base element to which toy blocks may be applied, is shown in another patent to Larws, U.S. Pat. No. 4,813,904, disclosing a base element for the production of panels for a toy construction system. Block configurations that may be assembled into socketed building blocks, is disclosed in another patent to Larws, U.S. Pat. No. 4,582,496. The application of plate elements, incorporating plug means, for securement within a base plate, is shown in the early United States patent to Zander, U.S. Pat. No. 3,274,727. Finally, building block assemblies are shown in the German patent No. 1,140,500. A Lego Company also has various connectable devices that may be built into structures through interengaging components.

The current invention takes the concept of formulating building blocks, into a system for assembly, to a further dimension, by constructing a light table, into which one or more energized light fixtures, mounted within either a transparent, but preferably translucent, table top, for projecting light through the upper surface of the table top, and then applying various light block sets, or game pieces, to the surface, either for laying flush thereon, and projecting light through the various planar like pieces, to illuminate and project their colors, whereby the light pieces may also be laid one upon the other, for showing how different colors may be blended, to provide yet a further coloration, as is so well known in the art. In addition, the light table top surface may also include a series of perforations therein, or a plurality of bores or sockets, and into which various light block pieces may be inserted, and built one upon the other, with the game pieces further incorporating the additional dimension of either being fiber-optic, or scintillating fiberoptic, so the transmitted light can extend through the game pieces, even when connected together, to project either a white or colored illuminated end, to the final game piece, as is also known in the art through the usage and application of fiber optics. In addition, translucent type of game pieces may be employed, and which may be applied to an illuminated table surface, which may be a flat configured table surface, or a socket type surface, in order to provide illumination to the applied pieces.

SUMMARY OF THE INVENTION

This invention relates to a light table, for use predominantly by children, either in a day care, nursery or school settings, and provides for the projection of light, through various game pieces or light block sets, not only for the amusement and entertaining of the children, during play, but also to provide the further dimension of educating them regarding the physics of light, its transmission through a medium, and how colors may vary through light wave combinations depending upon the color mix provided through the interconnection or overlying relationship of the various game pieces being assembled.

As stated, the subject matter of this invention is designed not only to provide for the entertainment and amusement of children at play, as aforesaid, but furthermore, based upon the learning possibilities that are available to young children, and their ability to comprehend and understand through visuals, this invention is designed to assist children in understanding the properties of light. Thus, the light table of this invention was developed as a safe, simple and effective system to accomplish both of these results. This invention, functioning as a light table system, consists of a reasonably enclosed table base, formed as a surface type platform, with special fluorescent tube(s) provided thereon, which when energized and illuminated, are designed to simulate daylight, and daytime conditions. These fluorescent lights shine through a translucent table top surface, provided thereon, which is configured in two different forms, one having either a smooth surface upon which the children may play, or one having a series of recesses, preferably integrally formed, therein, and extending downwardly from the top surface, and which may accept various light play materials, light blocks, or the like, which may be inserted therein, for projecting upwardly, and even to which additional light blocks, or game pieces, may be interconnected thereto. These table tops, whether of the smooth type, or recessed kind, may also be interchangeable upon the light table, by the teacher, without the use of any tools, but preferably will be complex enough that the children cannot achieve this result themselves. It is possible that the table top may also be constructed in the form of an easel, in order to afford it with a slight degree of slope, for the convenience of the children making use of the same.

On the smooth top surface, the children can lay flat pieces, such as gamelike pieces, again of preferably translucent, or transparent plastic, or of other related type material, whether it be a rigid plastic, or resilient like gelatin, to observe the effect of light being transmitted through a colored piece, or to lay a plurality of flat pieces, one on top the other, to learn the effects of mixing colors, and the resultant color obtained, a phenomenon of physics as is known. In addition, it is likely that the children may apply translucent or transparent sheets of polymer paper, to the surface, which may be either clear, or opaque, and draw thereon, with a marker, or the like, to see the effects of light coming therethrough, and the effect of light upon the translucent paper, or the personal markings made thereon. Stained glass effects can be created with cellophane, Jello, wax, or other materials, to provide a ready indication to the child of what effect light has upon different colored blocks, or flat pieces, to learn, in a minor way, this aspect of the physics of light and illumination, and the effects on light of colors, their mixing, and the resulting tints that can be obtained through the arrangement, rearrangement, and overlying of different colored means. As a further attribute, the light table of this invention can also be used for educational purposes, such as the study of nature by looking at the veins in leaves, the crystals in ice, the translucence of certain stones or rocks, all for the enhancement of the education of the child, in either a nursery or daycare setting, or even at home.

The table top surface of this invention, as previously described, and particularly that which includes a series of perforations, or integral sockets, can provide the support and structure for building other fabrications, especially those designed to fit in the specific recesses as formed into the table top, and special blocks can be made in clear or translucent colors so as to pass light from the table, illuminate the blocks internally, and allow the light to pass therethrough, to additional interlocking blocks, that may have been mounted thereon. Children can enjoy both the fun of building, and light study, as it is transmitted through the blocks.

To take the invention to a further dimension, fiber optic principles can also be taught and enjoyed through use of the table of this invention, as the light source may be transmitted through fiber optic blocks that may insert into the sockets formed of the table top, special connectors can tie the fiber optic blocks together, which blocks can be tinted to change the color passing therethrough, to provide a rainbow effect of coloration when a series of light blocks are viewed, when interconnected together upon the surface of the light table. Fiber optics, and scintillating fiber optics, can be used in the fabrication of the light block sets or pieces of this invention, when used in the above described manner, with their unique light gathering properties providing for the further education and the enhancement of the enjoyment of the child, when playing upon the light table of this invention.

As previously reviewed, a related type of table type, containing a series of bores, perforations, or sockets, is shown in the applicant's earlier U.S. Pat. No. 5,421,270, and entitled "Base Panel for Building Blocks."

The use of fiber optics in a variety of settings has become well known in the art. For example, fiber optics, including those of the scintillating kind, have been used in novelty type items, wherein a plurality of fine fibers are bundled together, with light entering into one end, or through the sides of the fibers when they are fabricated of the scintillating kind, illuminates out the opposite end of the fibers, to provide a rather attractive appearance, when used for this purpose. In addition, fiber optics, and scintillating fiber optics, have likewise been used for a variety of industrial purposes, as also known in the art. These types of fiber optics are sometimes also called fluorescent or light-collecting fibers. Normally, scintillating fibers consist of polystyrene-based core, and a polymethyl methacrylate (PMMA) cladding. The cladding thickness is approximately three percent (3%) of the fiber diameter. The scintillating core of the fiber contains a combination of fluorescent dopants, selected to produce the desired scintillation, optical and radiation-resistant characteristics. Fluorescent fibers collect or absorb light from the surroundings, through their cladding, and in one end, and then conducted within the material for re-emitting a large portion of the collected light in concentrated form at the other, or perhaps, or both ends, of the fibers. Scintillating fibers are used for decoration, when used for novelty or display items, or for radiation detection, when used for industrial purposes. Such fibers are readily available from Poly-Optical Products, Inc., of Irvine, Calif. 92714.

It is, therefore, the principal object of this invention to provide a light table which can be used for both play and educational purposes by children.

Another object of this invention is to provide a light table that may cooperate with planar pieces, in order to aid in the education of the child regarding illumination, and the mixture of colors.

A further object of this invention is to provide a light table, with a socketed top, and into which light block pieces may be inserted, built one upon the other, in order to transmit light, illuminate the game piece, and to assist in educating the child regarding colors.

A further object of this invention is to provide a light table that helps develop an understanding of color, as well as the ability to build projects.

Still another object of this invention is to provide a light table, for use in cooperation with a light block set, which may be fabricated of fiber optics, or scintillating fiber optics, to further aid in the education of children relating to transmission of light, and to provide for their further amusement at play.

Still another object of this invention is to provide a light table wherein its table top surfaces are interchangeable, between one that is socketed, and another which is of a flattened or planar configuration.

Still another object of this invention is to provide a light table where its top may be inclined, to facilitate the usage of the table during application.

These and other objects may become more apparent to those skilled in the art upon reviewing the subject matter of this invention, and upon undertaking a study of the description of its preferred embodiment, in view of its drawings.

DESCRIPTION OF THE PREFERRED EMBODIMENT

Figure 1:
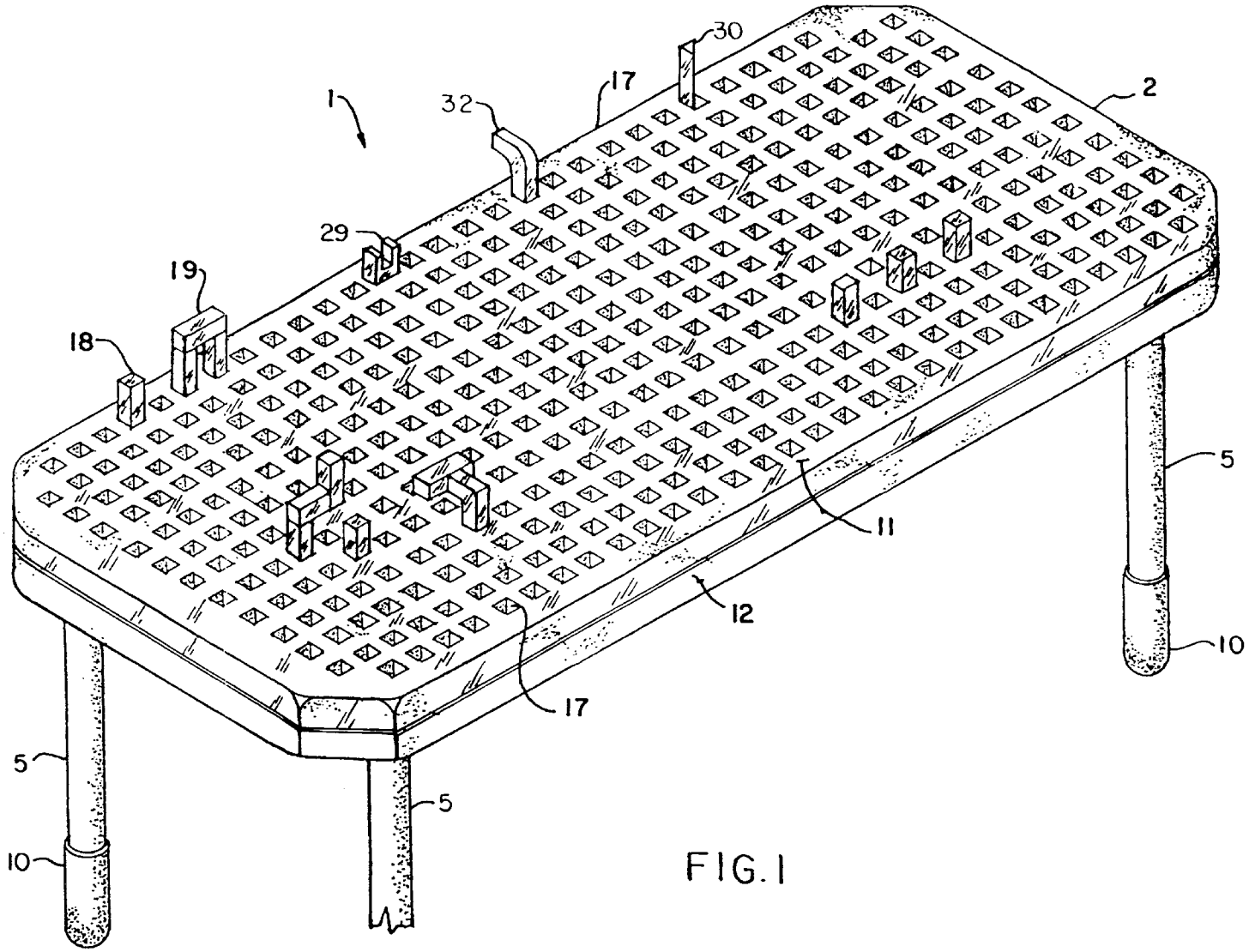
FIG. 1 is an isometric view of the light table of this invention, disclosing the socketed type table top surface, and into which building components or light blocks may be inserted.

In referring to the drawings, and in particular FIG. 1, the light table 1 of this invention is disclosed. It comprises a table top surface 2, as noted, which mounts upon a table surface platform 3 (see FIG. 2). As can be seen, the surface platform 3 includes a series of fluorescent lights, as at 4, and which mount within the table top surface platform 3, to provide for full illumination of the table top surface 2, as further disclosed separated therefrom in 2A. The combination of the table top surface 2, and the surface platform 3, holding the fluorescent lights, are held spacedly upwardly by means of a series of legs, as at 5, to provide for firm resting of the light table upon a surface, such as a floor, and to provide for its stabilization. There are four legs in number, one in each proximate corner of the table. Each leg may contain a bottom cap, generally formed of some form of softened polymer, as at 10, to provide for firm resting of the light table upon a surface, such as a floor, and to provide for its stabilization.

Figure 2:
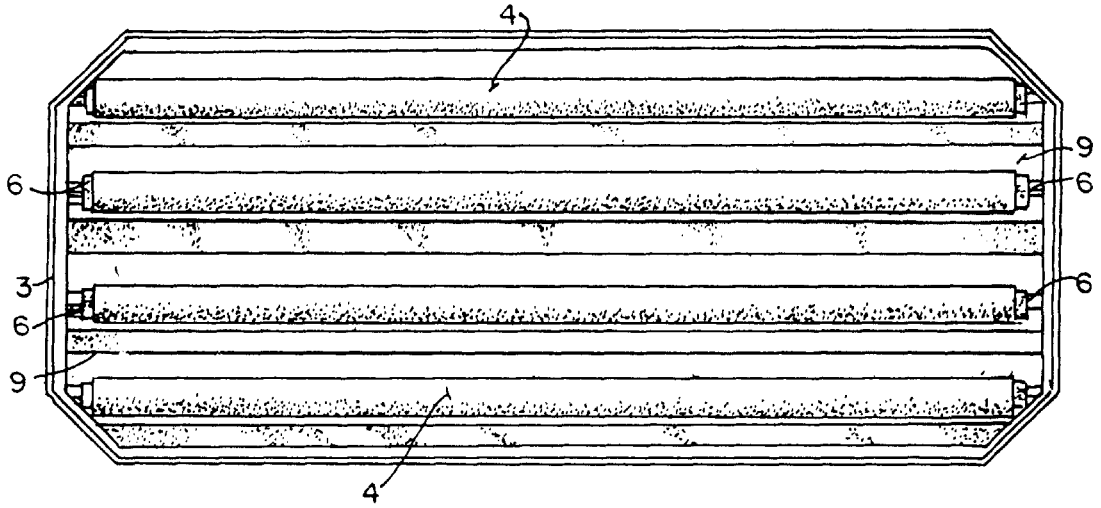
FIG. 2 is a planar view to that of FIG. 1, with the table top surface removed, to disclose its illuminating flourescent lighting system.

As can be seen in FIG. 2, the table surface platform 3 may be fabricated of wood, polymer, or the like, and which supports the various light sources, such as the fluorescent lamps 4, which are arranged between sockets 6, as is known in the art, and which connect by cable means 7 to the transformer and ballast 8, and which includes an electrical lead (not shown) integrated with the socket for plug into a wall or floor outlet, to provide energization of the said lamps. A switch may be interconnected within the circuitry, to provide for the turn-on or shut-off of the lamps, as desired.

Figure 2A:
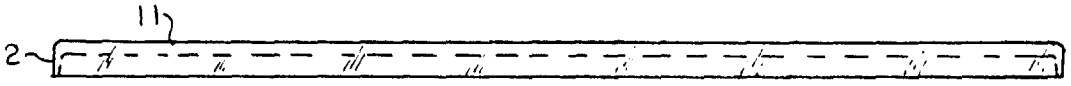
FIG. 2A is a side view of the lighting system holder of this invention.
Figure 2B:
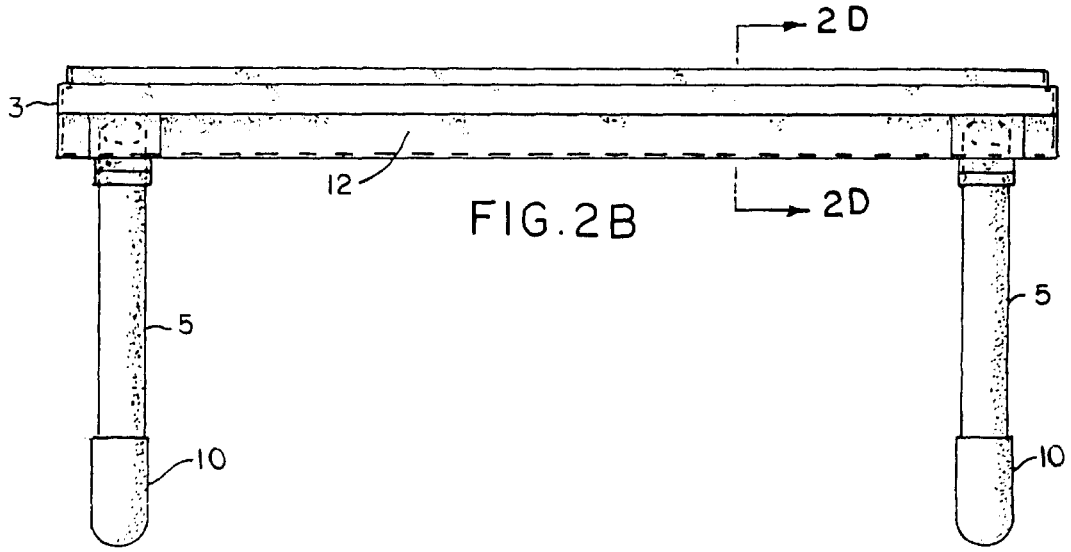
FIG. 2B is a side view of the light table as shown in FIG. 1.
Figure 2C:
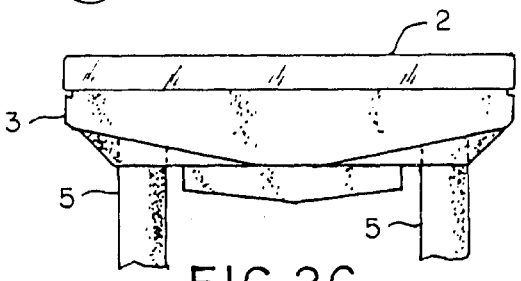
FIG. 2C is an end view thereof.
Figure 2D:
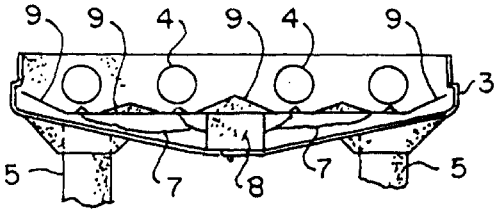
FIG. 2D is a transverse sectional view taken along the line 2D—2D of FIG. 2B.

As can further be noted in FIG. 2D, in addition to FIG. 2, a series of reflectors 9 are provided within the surface platform 3, beneath the lamps 4, for the purpose of providing full illumination and direction of the light upwardly, for transmission through the table top surface 2, as can be seen in FIGS. 2B and 2C.

As can be seen in FIGS. 1 and 2A, the table top surface 2, in this instance, comprises, preferably, a polymer formed surface 11, which around its perimeter, includes an integrally downwardly extending rim, as at 12, and this rim may be secured upon, or removably clipped to (not shown) the table surface platform 3, in any manner known in the art.

Figure 3:
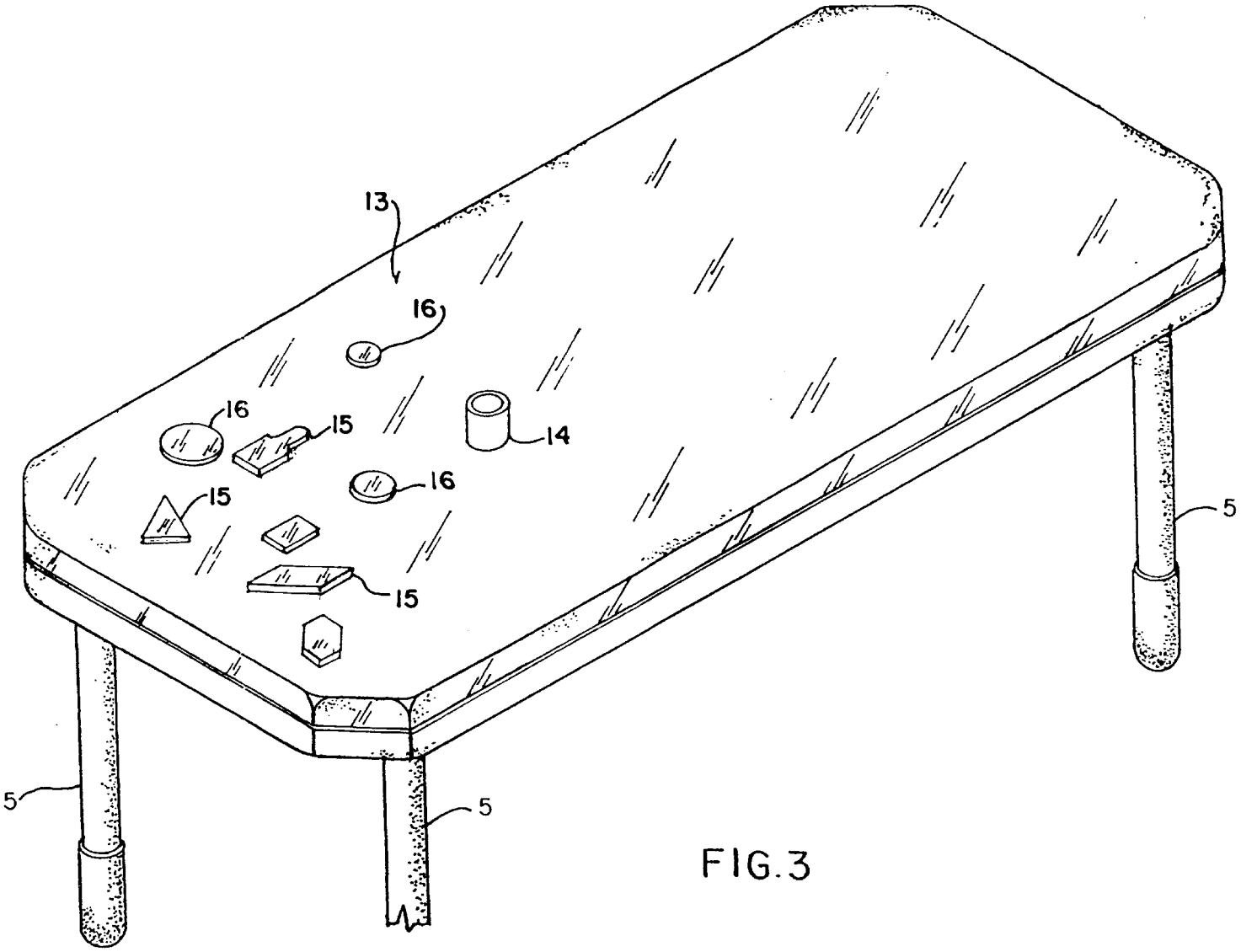
FIG. 3 is an isometric view of the light table of this invention, with its perforated table top surface being replaced by the flat style surface.

As previously reviewed, the table top surface 2, in addition to the alternative table top surface 13, as shown in FIG. 3, may be formed, such as by vacuum molding, injection molding, rotational molding, or the like, of a light translucent polymer, or even in particular instances perhaps even transparent plastic, so as to allow for the light rays generated from the flourescent lamps 4 to be emitted therethrough, and provide a bright lighting above each table top surface, regardless which one may be employed.

As can be seen in FIG. 3, the surface is planar of configuration, and readily accepts for both play and educational purposes thereon a series of planar configured rings, as at 14, blocks or squares, of various configuration, as shown at 15, and circular pieces, as at 16, and which pieces may be formed of various tints of color, such as blue, orange, yellow, green, or the like, so that the light being transmitted through the translucent surface 13 radiates through the various game pieces, to provide an attractive and readily illuminated colored block, which may be aestethically pleasing to the children, during play, or provide them with a basis for education, regarding colors, and their changeability, during usage. For example, as known, when colors are mixed, such as when a yellow square is applied upon a blue piece, the transmitted color from the two will be green, providing a quick means for educating the children as to how emanated light may be changed, by mixing of its coloration, to achieve different colors due to the combining of the light wave lengths. Similar type aethestics can be attained by applying, for example, a circular piece 16 onto the ring 14, so that different colored shades can emanate from the combined pieces. As previously also reviewed, other types of game pieces may also be applied, such as translucent or transparent sheets of polymer paper, either clear, or tinted to various colors, such as fabricated of cellophane, or the like, to add to the pleasure and education of the child during usage of this particular invention.

As can also be seen in FIG. 1, the table top surface 11 may include a series of integrally formed sockets, as at 17, constructed in the manner as previously described in the applicant's earlier U.S. Pat. No. 5,421,270, and which sockets or perforations may readily accept the introduction or insertion of game pieces or light blocks, such as 18, therein, and issue transmitted light, from the fluorescent lamps, in the various hues of colors from which the light blocks are fabricated. These blocks likewise may be formed of transparent or translucent material, so as to readily transmit light therethrough, and provide the transmission of a hue of color that is pleasing to the children at play, and to help educate them regarding transmitted light. These blocks may be built one upon the other, as can be seen at 19, so as to provide for the transfer and transmission of light therethrough, through their built-up configuration. Other various shapes for game pieces, as can be noted as applied into the table top surface 2 as shown in FIG. 1, can also be seen. In addition, as previously explained, these light blocks may be formed of fiber optics, or even scintillating fiber optics, wherein light entering into one end, or through their lateral surfaces, may be transmitted to their exposed ends, to provide a highly illuminated tip to the endmost edge of the light block, when assembled together, to provide a rather pleasing appearance to the excited children, during play, and to further provide them with means for educating them, regarding the transmission of light, even by way of fiber optics, through the application and fabrication of structures formed from the various light blocks assembled in the manner of this invention.

Figure 4A:
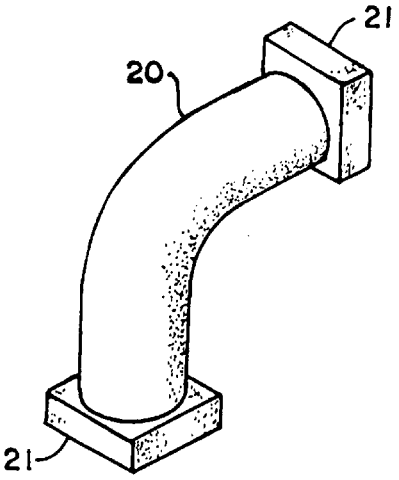
FIG. 4A is an isometric view of one of the fiber optic style of light blocks of this invention.
Figure 4B:
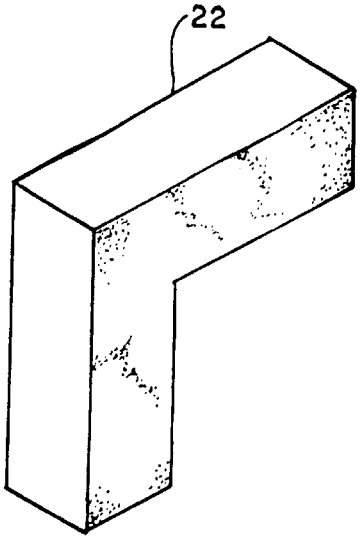
FIG. 4B is an isometric view of another light block of this invention.
Figure 4C:
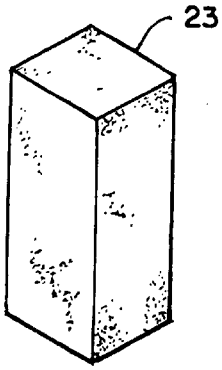
FIG. 4C is a view of a further modified light block of this invention.
Figure 4D:
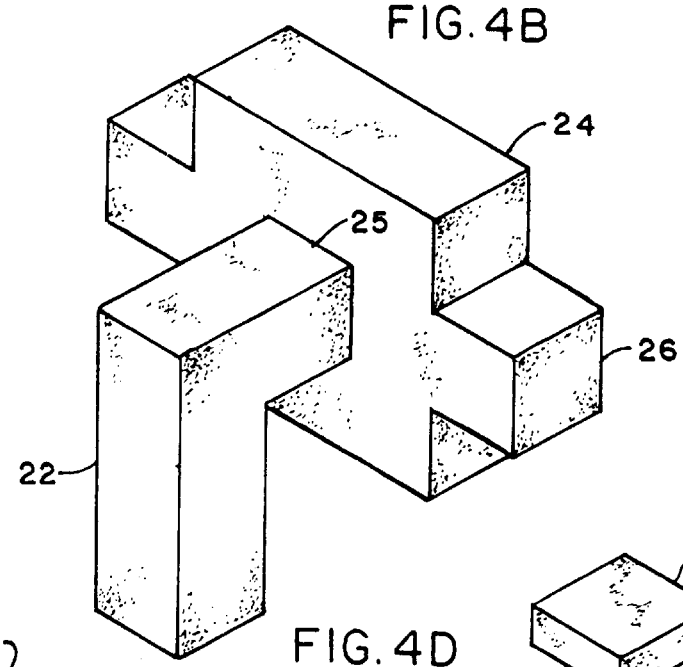
FIG. 4D discloses an isometric view of how light blocks may be combined together into a fabricated structure.
Figure 4F:
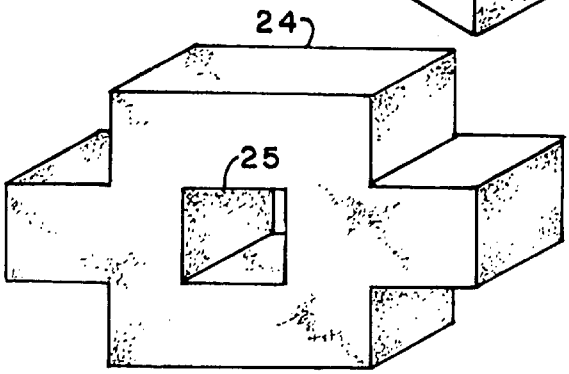
FIG. 4F shows an isometric view of another light block of this invention, of the type combined in FIG. 4D.
Figure 4E:
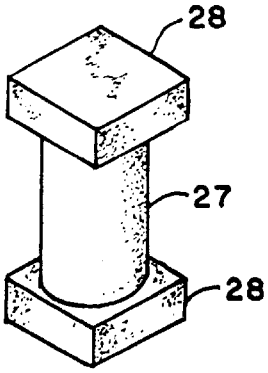
FIG. 4E is an isometric view of another of the light blocks.
Figure 4G:
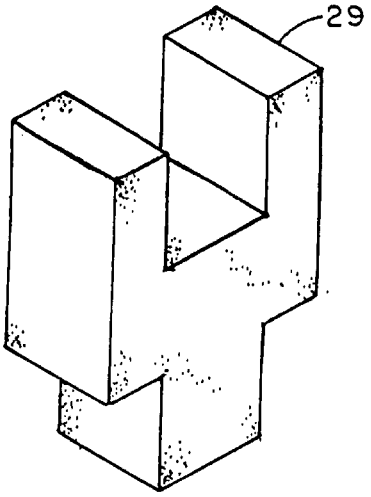
FIG. 4G shows another light block of this invention.
Figure 4H:
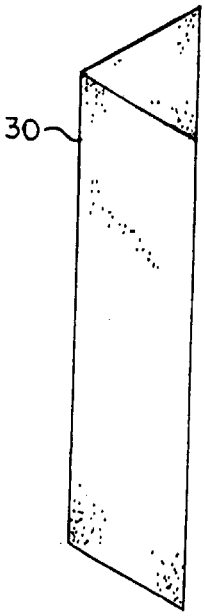
FIG. 4H shows a further light block of this invention.
Figure 4I:
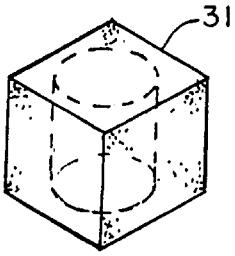
FIG. 4I shows an additional light block of this invention.
Figure 4J:
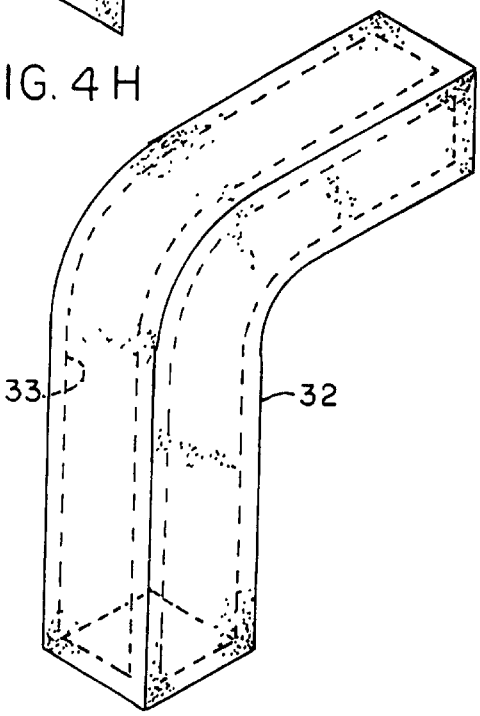
FIG. 4J shows another light block of this invention.

Various styles of light blocks, or game blocks, for use in conjunction with this invention, are readily disclosed in FIGS. 4A through 4J, as noted. Since fiber optics may be involved, FIG. 4A discloses and educates how light may be transmitted through a curved piece, as at 20, through the use of fiber optics. The mounting blocks 21, integrally formed, may be used for inserting within the sockets 17, or the curved piece 20 may be fabricated to that diameter to provide for a squaring of their ends, to provide for their reception by said sockets 17. FIG. 4B discloses how a light block may be fabricated, integrally, of an angulated piece 22. FIG. 4C discloses how a light block may be a length of square, rectangular, or other convenient shapes, fabricated from fiber optic, or translucent material, as at 23, or rectangularly fabricated fiber optic, as can be seen. FIG. 4D discloses how a formed light block 24 may include a central aperture, as at 25, to provide for its insertion onto the style of light block 22, as previously explained. In this manner, particularly if the light blocks are fabricated of scintillating fiber optics, it may be that light can be transmitted from one light block to the other, so as to provide for the emanation of light, from their ends, such as the end 26 as noted. FIG. 4F discloses the light block 24, and shows how its aperture 25 is provided therein. FIG. 4E discloses how a cylinder or length of cylindrical light block 27 may have integrally formed square portions 28 at its ends, or may have the ends of the cylinder 27 squared off, to provide for their insertion and retention within the sockets or perforations 17 of the table top surface 11. FIG. 4G shows a forked or bifurcated style of light block 29, while FIG. 4H shows triangulated form of light block 30, as can be noted. FIG. 4I shows a cube style light block 31, with a cylindrical-like hollow interior, as can be seen. FIG. 4J shows a light block, as at 32, which integrally forms a curvature and is oriented into a horizontal direction, as can be seen. These are just examples of the myriad of shapes that may be provided to the light blocks of this invention, in order to provide for the illumination and transmission of light, for purposes as previously described.

The light blocks also may be fabricated, by vacuum molding, so that their interiors are hollow, even though they provide the appearance of a solid block externally, so that light may be transmitted through their walls, and this also can be noted from the hollow interior formed at 33 for the light piece as shown in FIG. 4J.

It is also likely, as disclosed in FIG. 1, that the bottom surfaces of the sockets 17, which cannot be seen herein, may be fabricated of transparent polymer, such as by applying a sheet of polymer thereunder, in order to more readily transmit light from the illuminated lamps, while the remainder of the table top surface 2 may be fabricated of translucent polymer, for use for the purposes of this invention. Also, the bottom of the sockets may be just left open, to provide for a direct transmission of light. The object is to transmit the maximum of radiated light through the table top surface, whether it be as shown in FIG. 1 or FIG. 3, from the lamps as disclosed in FIG. 2, without providing a detriment to the use, viewing and playing upon the light table, by the children, during application and usage of a table of this design. As previously explained, the table top surfaces 2 and 13 are interchangeable, so that the light table can be converted for usage with the variety of light blocks and light pieces, as shown and described herein. Obviously, the table top surfaces may likewise be tinted to the desired color, when fabricated of either translucent or transparent polymer, but preferably, to achieve the results of the invention as desired herein, the surfaces may be formed of white translucent polymer to provide the maximum transmission of radiated bright light.

Figure 5A:
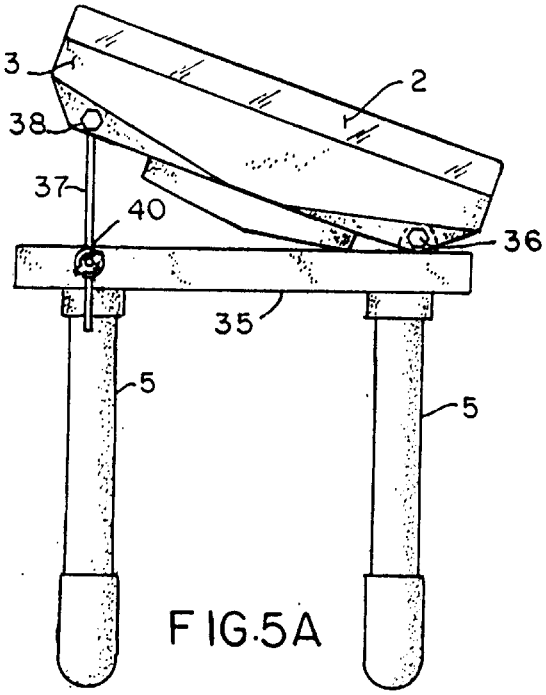
FIG. 5A provides a side view of the light table mount to show its adjustment into an inclined easel-like light table.
Figure 5:
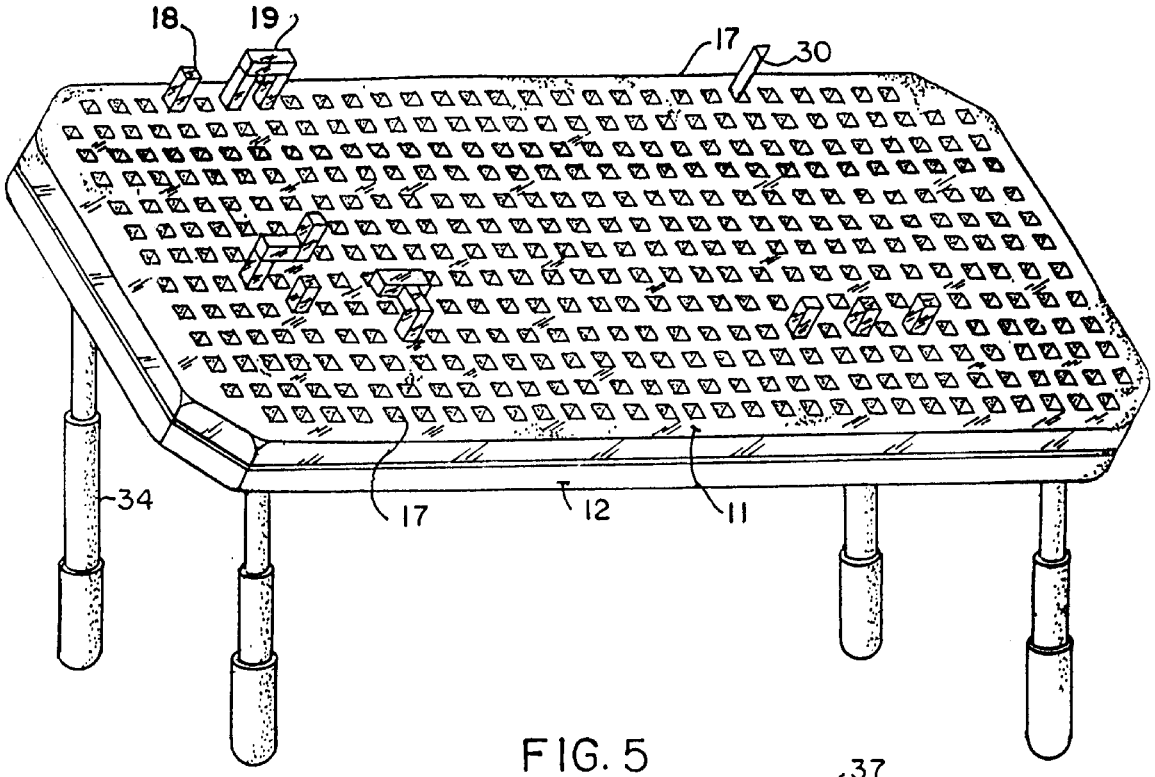
FIG. 5 is an isometric view of the light table of this invention, but disclosing how the table legs may be telescoping in design, to provide for an incline to the table surface.

A slight variation upon the invention as shown in FIG. 5, wherein the table top surface may be inclined, either through the use of telescoping legs, as can be seen at 34, where the back legs may telescope into a greater length than the front legs, so as to incline the table top surface to the side, like an easel, for the convenience of usage by the children. On the other hand, the table top surface, which includes both its surface 2, and the surface platform 3, may pivotally mount to a platform 35, to which the legs 5 may connect, while the one side of the surface platform 3 may be pivotally connected, as at 36, to the platform, while the other edge may be supported by an adjustment rod 37, one provided at each end of the table, to fix the incline of the table at a desired inclination, for the convenience of the user.

Figure 5G:
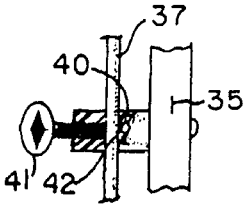
FIGS. 5C through 5G show various components providing for the incline support to the light table.
Figures 5B, 5C:
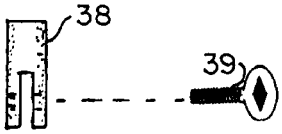
FIG. 5B shows a component of the easel support.
Figure 5D:
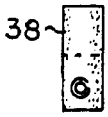

The various components employed in providing for this easel-like adjustment to the table top surface and platform are shown in FIGS. 5B through 5G. FIG. 5B discloses a fitting that connects to the undersurface of the surface of the platform 3, at the vicinity of 38. The support rod 37 may be used to fix the table top surface at its desired inclined position. The components 37 and 38 are held together, in a pivotal relationship by means of the fastener 39. FIG. 5G discloses a swivel fastener, as at 40, which attaches to the side of the platform 35, and a wing nut 41 threadedly engages therein so as to bind the bottom of the rod 37 that inserts through its aperture 42, when fixing the table top surface at its elevated position.

Figure 5H:
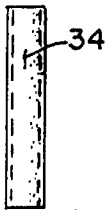
FIG. 5H shows a section of the telescoping type table leg.
Figure 5E:
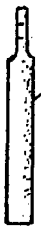
Figure 5F:
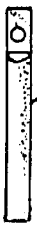
Figure 5I:
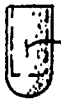
FIG. 5I shows a lower leg cap for the light table leg.

FIGS. 5H and 5I disclose a segment of the table legs, and the bottom cap 10, as previously described.

Variations or modifications to the subject matter of this invention may occur to those skilled in the art upon reviewing the subject matter of this disclosure. Such variations or modifications, if within the spirit of this invention, are intended to be encompassed within the scope of any claims to patent protection issuing upon this development. The description of the preferred embodiment provided herein, and as shown in the drawings, is set forth for illustrative purposes only.

We claim:

1. A light table for use in a nursery, school, and the like, comprising, a table, said table having a surface platform and a series of legs for supporting the surface platform above the floor, a light means for producing light provided on said surface platform, electrical means connecting with the light means for conducting electrical charge for providing illumination for the light means, a table top surface provided upon said surface platform, said table top surface being a planar surface, said table top surface furnishing a smooth surface, an additional table top surface furnishing a perforated surface, said table top surfaces being interchangeable in their connection upon the light table surface platform, said perforated table top surface including a series of spaced sockets, said table top surfaces being at least partially one of translucent and transparent so as to allow the generated light to be transmitted therethrough, and at least one light transmitting means provided for cooperating upon the table top surface for projecting the light transmitted through the table top surface to project colored light through the light transmitting means for observance, and at least one reflector provided between the surface platform and the light means to provide for reflection of light upwardly and towards the table top surface.

2. The light table of claim 1 wherein said light transmitting means comprising light blocks.

3. The light table of claim 1 wherein said light transmitting means comprising a flat piece of light transmitting means.

4. The light of table of claim 3 wherein said light transmitting means comprise shaped planar pieces.

5. The light table of claim 2 wherein said light blocks comprise a series of shaped blocks capable of inserting within the table top surface sockets.

6. The light table of claim 2 wherein said light blocks are formed of one of transparent and translucent polymer allowing the transmission of light therethrough.

7. The light table of claim 6 wherein said light blocks are formed of fiber optic type polymer.

8. The light table of claim 6 wherein said light blocks are formed of translucent type polymer.

9. The light table of claim 7 wherein said fiber optic light blocks are scintillating.

10. The light table of claim 1 wherein said table top surfaces may be oriented upon an incline.

11. The light table of claim 10 wherein select of said table legs being telescopically formed to provide for their extension and orientation of the table surface platform upon an incline.

12. The light table of claim 10 and including said light table including a base, said base supporting said table legs, said surface platform being pivotally mounted along one edge to the base, the opposite side edge of said surface platform being elevateable, a support rod holding said surface platform in its elevated position, to provide for the retention of said surface platform and said table top surface upon an incline.

13. The light table of claim 6 wherein said light blocks are formed having a hollow interior.

14. The light table of claim 1 wherein said electrical means is concealed between the light reflector and the surface platform.

15. The light table of claim 1 wherein said table top surfaces are capable of being inclined.

* * * * *